US005239939A

United States Patent [19]

Purdy

[11] Patent Number: 5,239,939

[45] Date of Patent: Aug. 31, 1993

[54] DOWNHAUL DEVICE

[76] Inventor: Kevin B. Purdy, 5837 Nottingham Dr., El Sobrante, Calif. 94803

[21] Appl. No.: 903,002

[22] Filed: Jun. 23, 1992

[51] Int. Cl.[5] ..... B63H 9/04

[52] U.S. Cl. ..... 114/109; 114/39.002; 114/102

[58] Field of Search ..... 114/39.2, 102, 103, 114/108, 109, 112, 90, 93, 89

[56] References Cited

U.S. PATENT DOCUMENTS 4,699,073 10/1987 Farneti ..... 114/39.2
4,977,843 12/1990 Ewert et al. ..... 114/109

FOREIGN PATENT DOCUMENTS 3324900 10/1984 Fed. Rep. of Germany ..... 114/109
3636007 5/1988 Fed. Rep. of Germany ..... 114/109

*Primary Examiner*—Edwin L. Swinehart
*Attorney, Agent, or Firm*—Heller, Ehrman, White & McAuliffe

[57] ABSTRACT

A downhaul device for tensioning a sail attached to a mast. The device includes a lever having a cleat at one end. The lever is pivotally attached to a fulcrum which can be removably mounted on the base of the mast. A downhaul sheet attached to the sail is passed through the cleat on the lever. Moving the lever in one direction causes the cleat to grip the sheet and pull it through another cleat attached to the mast and apply tension to the sail. Moving the lever in an opposite direction releases the sheet. The lever may thus be operated with a ratcheting action to incrementally apply tension to the sail.

8 Claims, 4 Drawing Sheets

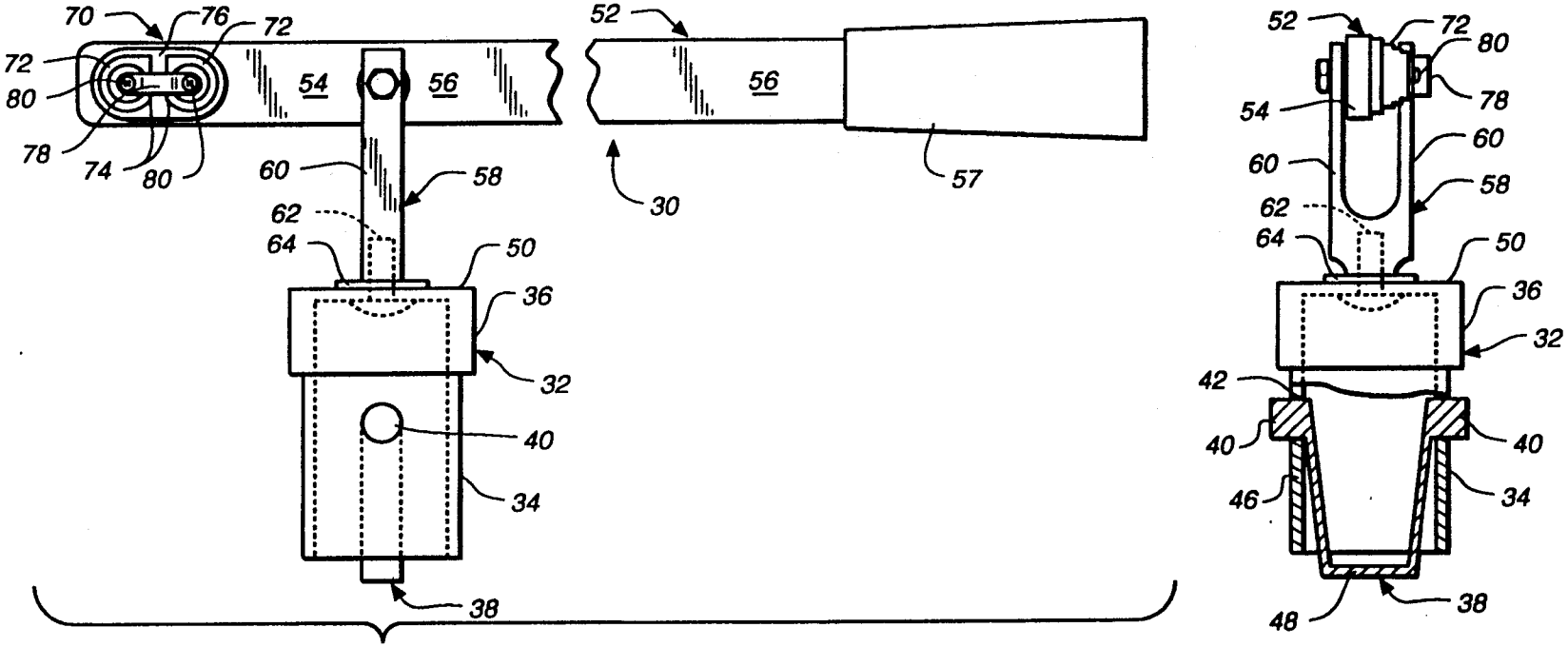
FIG._3
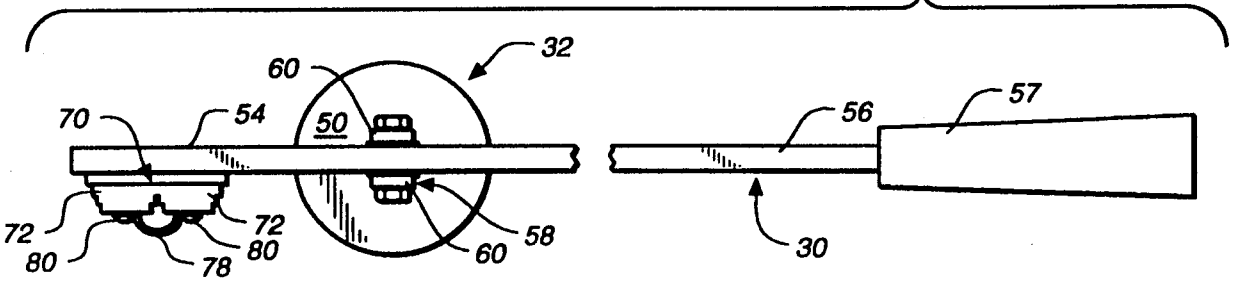
FIG._4
FIG._5

DOWNHAUL DEVICE

BACKGROUND OF THE INVENTION

The present invention is related generally to downhauling sails in sailing craft. It is related in particular to tensioning sails of sailboards or windsurfing craft.

A conventional sailing craft such as a sailing dinghy or a yacht is generally equipped with sheets, halyards, winches and the like for adjusting the form and tension of one or more sails to suit wind and weather conditions and point of sail. Tension adjustments may be made while the craft is afloat and in motion.

A sailboard or windsurfing craft generally has only one sail. This sail must be tensioned before the craft is put afloat and may not be adjusted while the craft is afloat and in motion. Further, as windsurfing crafts are designed to travel at speeds up to forty-five knots, the one sail is generally placed under a high degree of tension to prevent the sail from being deformed by its motion through the air.

A windsurfing craft generally has only three major components, a board, a mast and a sail. Sailboards are designed to be stored with these three components disassembled and transported in this disassembled state to a point of use.

A windsurfing craft is assembled by attaching the sail to the mast and then attaching the sail and mast to the board. The sail generally has a sleeve at the leading edge or luff. The sail is attached to the mast by sliding the sleeve over the mast from the top of the mast. A cap at the top of the sleeve eventually limits travel of the sleeve down the mast. A rope or sheet (also referred to as a downhaul) is attached at one end to the base of the sail near to the mast. A free end of the sheet is passed through a cleat attached to the base of the mast. The cleat allows tension to be applied to the sail by pulling on or downhauling the portion of the sheet extending through the cleat. The cleat maintains the tension by preventing the sheet from returning through the cleat. Once the sail is tensioned, the mast is attached by its base to a mast cup flexibly mounted on the board, and the assembly is complete.

To optimally tension the sail requires the application of substantial force, generally such that a person of average strength would be required to pull on the sheet with both arms and attempt to brace against the mast with one or both feet. This may lead to injuries and abrasions due to slippage of the feet on the mast. In particular, it may lead to lower back injuries due to the awkward position which must be adopted to brace against the mast and downhaul the sail.

Clearly there is a need for a sail tensioning device for windsurfing craft which allows a person to tension a sail from a comfortable and safe attitude with the minimum of effort.

SUMMARY OF THE INVENTION

The present invention is directed to a downhauling apparatus tensioning a sail used on a sailboard or windsurfing craft. In such a craft, the sail is generally triangular. The sail may be attached to a mast by sliding the mast through a sleeve at the leading edge of the sail until a cap on the sleeve contacts the mast. The sail is attached to the base of the mast by a rope or sheet attached to a corner of the sail at the base thereof. The sheet extends through a first cleat attached to the base of the mast. The sail may be tensioned by pulling on the portion of the sheet extending through the cleat. The first cleat permits the sheet to be pulled freely through it in one direction, for applying tension to the sail, and prevents the sheet from passing in an opposite direction such that tension applied to said sail is maintained.

The invention comprises a lever having a first portion and a second portion. The lever is pivotally attached between the first and second portions to a fulcrum. Mounting means are provided for removably attaching the fulcrum to the base of the mast.

The lever includes a second cleat attached to the first portion thereof. The second cleat is configured for gripping the length of the sheet extending through the first cleat when the second portion of the lever is moved in one direction, and for releasing the sheet when the second portion of the lever is moved in an opposite direction. This enables the sheet to be incrementally pulled through the first cleat for applying tension to the sail.

When the second portion of the lever is longer than the first portion, a mechanical advantage is provided for pulling the sheet. The ratio of the lengths of the second and first portions of the lever may be selected to provide sufficient mechanical advantage such that a person may properly tension the sail by operating the lever with only one hand.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

FIG. 3 schematically illustrates a side elevation view of the embodiment of FIG. 2.

FIG. 4 schematically illustrates a plan view of the embodiment of FIG. 2.

FIG. 5 schematically illustrates an end elevation view of the embodiment of FIG. 2

DETAILED DESCRIPTION OF THE INVENTION

Figure 1:
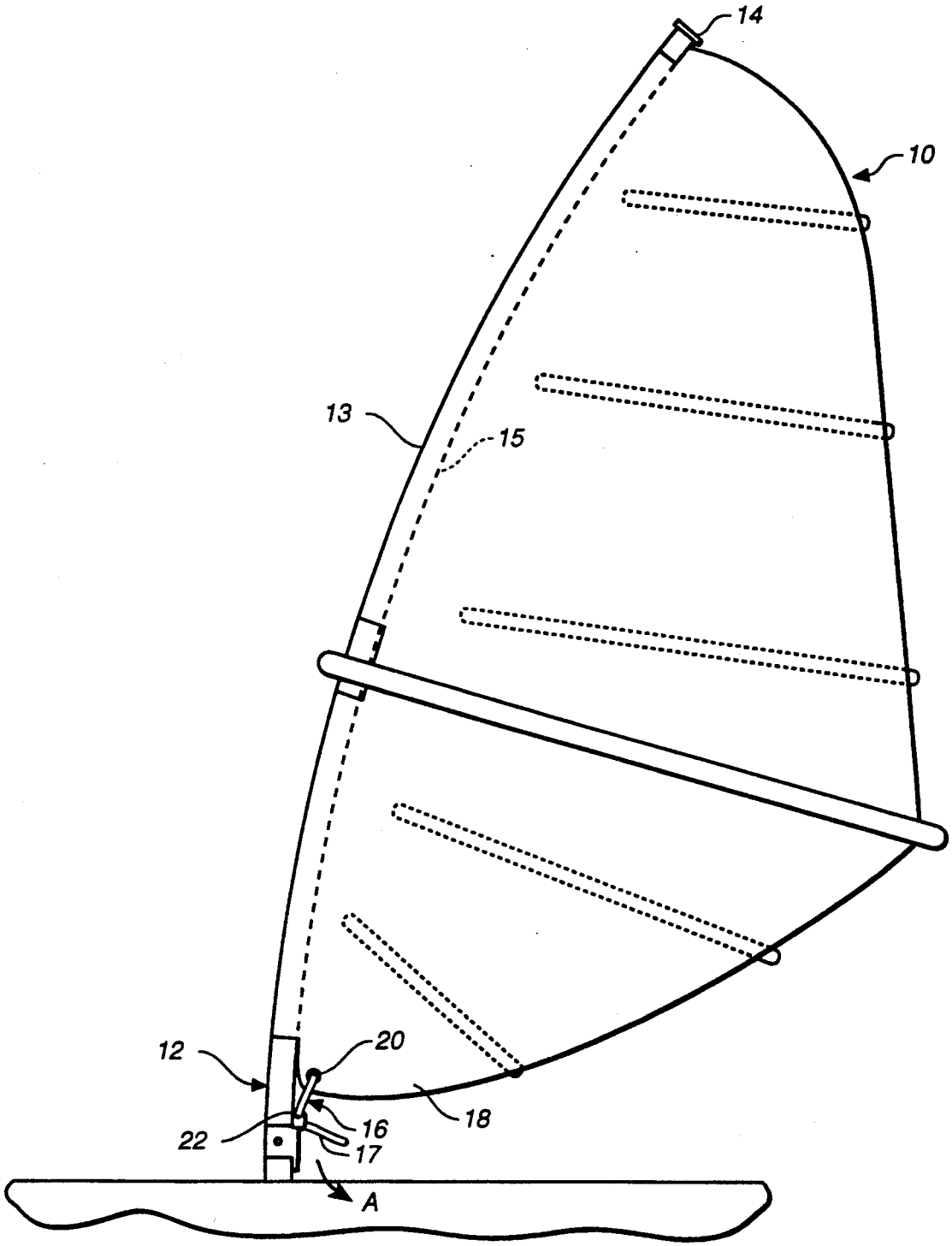
FIG. 1 (PRIOR ART)
FIG. 1 schematically illustrates a method of attaching a mast to a sail according to the prior art.

Turning now to the drawings whereon like components are designated by like reference numerals, FIG. 1 shows a generally accepted method for attaching a sail 10 to a mast 12 for use on a sailboard or windsurfing craft (not shown). The sail 10 is generally triangular in shape. The luff or leading edge 13 of sail 10 includes a sleeve indicated by phantom line 15. The sleeve may be slid onto mast 10 from the top thereof until it is prevented from sliding further by a cap 14. Alternatively, a sail such may be slidably attached to a groove in a mast by means of a bead extending along its leading edge of the sail.

A sheet 16, which may also be referred to as a rope (or downhaul) is attached to a corner 18 of sail 10. The sheet 16 may be attached to sail 10, for example, by looping it at one end through an eyelet or grommet 20. A length 17 of sheet 16 extends through a cleat 22, such as a cam cleat, attached to base 22 of mast 12. Cleat 22 is fitted with a cam 26 (see FIG. 2 for detail) which allows sheet 16 to be pulled freely in a direction indicated by arrow A for applying tension to sail 10, but prevents sheet 16 from returning in a opposite direction when the pulling stops. The means by which such a cam cleat operates is well known in the art and no further description thereof is included.

Figure 2:
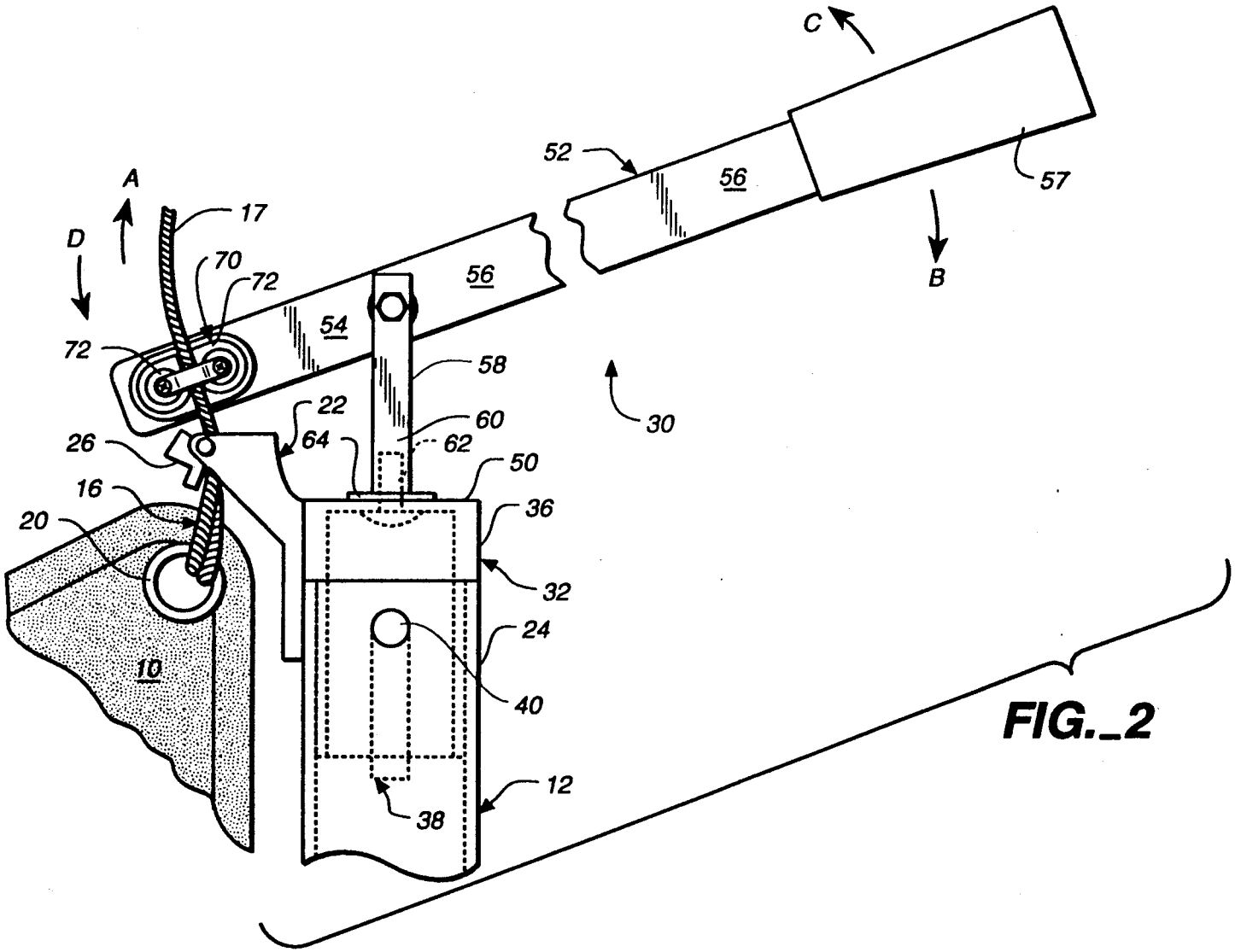
FIG. 2 schematically illustrates an embodiment of the present invention including a cam action cleat and attached to the base of a mast for tensioning a sail.

Turning now to FIG. 2, a method of using an embodiment of a downhaul device 30 according to the present invention is illustrated. Details of device 30 are illustrated in FIGS. 3, 4, and 5. Generally, mast 12 is tubular in form. Downhaul device 30 includes a mounting member 32 which is attached to base 24 of mast 12.

The mounting member 32 includes two generally coaxial cylindrical portions 34 and 36, and a base 50. (see FIGS. 3 and 5). Cylindrical portion 34 has a diameter such that it may be inserted into mast 10 at base 24 thereof. Cylindrical portion 34 includes a spring clip arrangement 38 for removably securing mounting member 32 on mast 12 when it is inserted therein. In one embodiment, spring clip arrangement 38 comprises two generally cylindrical plug members 40 which are free to slide in diametrically opposite apertures 42 in wall 46 of cylindrical member 38. Plug members are attached to a generally U-shaped spring 48. Cylindrical portion 36 has a diameter sufficient that it may engage the base of mast 12 and rest against it.

Pressure may be applied manually to plug members 40 to permit cylindrical portion 34 of mounting member 32 to be inserted into mast 12. Mounting member 32 may be inserted into the mast until cylindrical portion 36 engages the mast base. At this point plug members 40 are pushed by compression of spring 48 into diametrically opposite apertures in mast 10, thus securing mounting member 32 in place on the mast.

Mounting member 32 is preferably made from molded plastic. It may, for example, be simply a standard mast cup ordinarily attached to a sailboard for mounting a mast.

Referring now to FIGS. 3, 4, and 5, downhaul device 32 includes a lever 52 pivotally attached between first and second portions 54 and 56 thereof to a fulcrum 58. In one embodiment, lever 52 may be made from aluminum bar about one-quarter inch by one inch in section. First portion 54 is preferably shorter than second portion 56 for providing a mechanical advantage. First portion 54 preferably has a length of about four inches (4 in.) and second portion 56 preferably has a length of about twenty inches (20 in.) A rubber handle 57 may be included on lever 52 for convenience and comfort of operation.

In one embodiment, fulcrum 58 is a generally U-shaped aluminum bracket having parallel spaced-apart arms 60. It is (pivotally) attached to base 50 of mounting member 32 by a bolt 62 and a washer 64. Lever 52 is attached to fulcrum 58 between arms 60 by a pivot bolt 66.

Attached to first portion 54 of lever 52 is a cleat 70. In one embodiment, cleat 70 is a cam action cleat including two moveable cams 72 having toothed gripping surfaces 74 for engaging a rope or sheet passed through a gap 76 therebetween (see FIG. 2). Such a cam action cleat may be a model 279 Harken cam cleat obtainable from the Harken Company of Pewaukee, Wisc. Preferably, cleat 70 is provided with a retaining loop 78 attached to pivot bolts 80 of cams 72. Retaining loop 78 prevents a rope or sheet for falling out of gap 76 when cams 72 are opened and surface 74 move apart.

Continuing with reference to FIG. 2, cleat 70 is mounted on lever 52 such that when second portion 56 thereof is moved in a direction indicated by arrow B cams 72 move to close gap 76 and grip length 17 of sheet 16. Continued motion of second portion 56 in the direction of arrow B causes sheet 16 to be pulled in the direction of arrow A, thus applying tension to sail 10.

When second portion 56 of lever 52 is moved in the direction of arrow C, first portion 54 moves in the direction of arrow D, causing cams 72 to open gap 76 and release sheet 16. Sheet 16 is prevented from moving in the direction of arrow D by cleat 22 and cam 26. Because of this, cleat 72 slides along sheet 16 toward cleat 22. When second portion 56 of lever 52 is again moved in the direction of arrow B, sheet 16 is again gripped by cleat 72 and additional tension can be applied.

The above described operation of downhaul device 30 may be repeated such that tension is applied, in effect, by a ratcheting action of lever 32, incrementally pulling sheet 16 through cleat 22 and incrementally increasing tension on sail 10. Once tensioning is complete, sheet 16 may be removed from cleat 72. Mounting member 32 may be unclipped from mast 12 for removal therefrom by pressing manually on cylindrical members 44.

Figure 6:
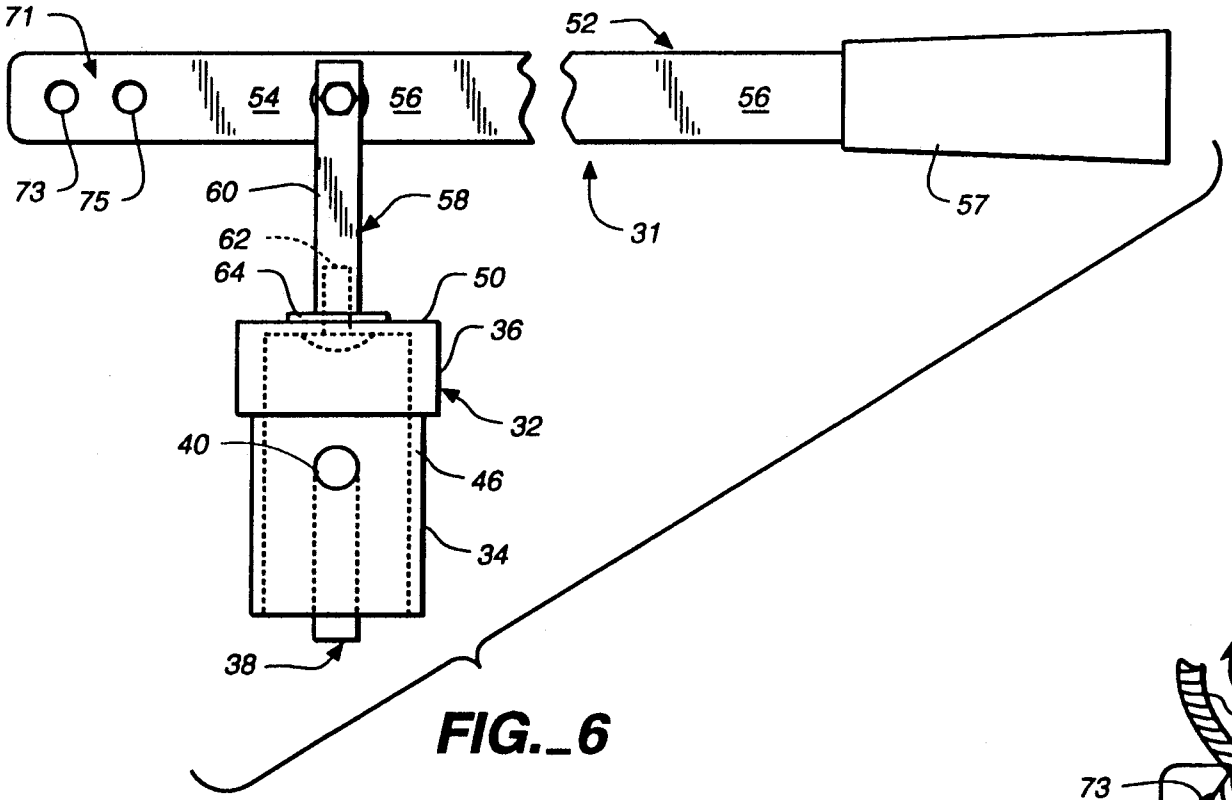
FIG. 6 schematically illustrates an alternate embodiment of the present invention including a two-hole cleat.
Figure 6A:
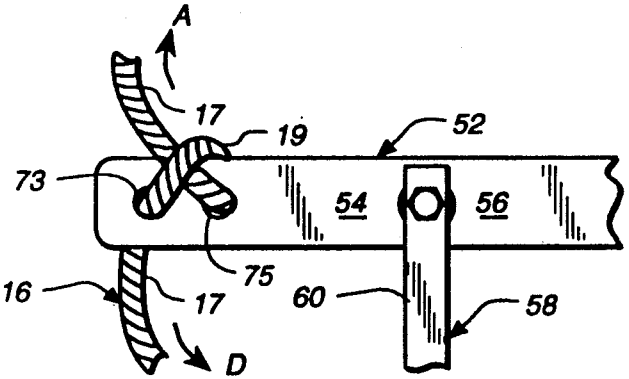
FIG. 6*a* schematically illustrates a method for attaching a downhaul to the two-hole cleat of FIG. 6.

Turning now to FIG. 6, an alternate embodiment 31 of downhaul device 30 is shown. Here, lever 52 includes a simple form of cleat 71 comprising two spaced-apart holes 73 and 75 in first portion 54 of lever 52. Referring to FIG. 6*a*, a method of attaching sheet 17 to cleat 71 is shown. Length 17 of sheet 16 is first passed through hole 73 in a first direction and over lever 52 in the opposite direction to form a loop 19. Length 17 is then passed through hole 75 in the first direction and through loop 19. When first portion 54 of lever 52 is moved in the direction off arrow A, loop 19 tightens and grips sheet 16 so that sheet is pulled to apply tension to sail 10. When first portion 54 of lever 52 moves in the direction of arrow D, i.e., in the opposite direction to arrow A, loop 19 is loosened, releasing sheet 16. Loop 19 may be drawn tight by manually drawing length 17 of sheet 16 through holes 73 and 75, and first portion 54 of lever 52 may be again moved in the direction of arrow A to apply tension to sail 10.

In view of the foregoing, it will be evident that the downhaul device of the present invention provides a convenient method of assembling a sailboard having a mast, a sail, a sheet for tensioning the sail, and a board including a mast cup for removably attaching the mast to the board. Assembly of the sailboard and tensioning the sail may be completed without a requirement for substantial physical effort. Steps of the assembly method include: attaching the mast to the sail; passing the sheet through a first cleat attached to the base of the mast; attaching a downhaul device according to the present invention to the base of the mast; passing the sheet through a second cleat on the downhaul device; operating the lever in a ratcheting motion to apply tension to the sail; removing the sheet from the cleat on the lever; removing downhaul device from the base of the mast; and inserting the mast into the mast cup to complete assembly of the sailboard.

The present invention has been described in terms of a preferred embodiment. The invention is not limited, however, by the embodiments described and depicted. Rather, the invention is defined by the appended claims.

What is claimed is:

1. A downhauling apparatus for a sail slidably attached to a mast, said sail having sheet means for applying tension thereto, said sheet means attached at one end thereof to said sail and said sheet means having a length thereof extending through first cleat means attached to the base of said mast, said first cleat means permitting said sheet means to be pulled freely therethrough in one direction for applying tension to said sail and preventing said sheet means from passing in an opposite direction therethrough, such that tension applied to said sail is maintained, the apparatus comprising:

lever means having a first portion and a second portion;

said lever means pivotally attached between said first and second portions to fulcrum means;

mounting means for removably attaching said fulcrum means to the base of said mast;

said lever means having second cleat means attached to said first portion thereof; and said second cleat means configured for gripping the length of the sheet means extending through said first cleat means when said second portion of said lever means is moved in one direction, and for releasing the length of the sheet means when said second portion of said lever means is moved in an opposite direction, whereby the said sheet means may be incrementally pulled through said first cleat means for applying tension to the sail.

2. The apparatus of claim 1 wherein said fulcrum means is pivotally attached to said mounting means;

3. The apparatus of claim 1 wherein said first portion of said lever means is shorter than said second portion of said lever means.

4. The apparatus of claim 1 wherein said second cleat means is a cam action cleat.

5. The apparatus of claim 1 wherever said second cleat means includes two spaced-apart holes through said first portion of said lever means.

6. The apparatus of claim 1 wherein said mounting means includes first and second generally coaxial cylindrical portions, said first cylindrical portion having a diameter such that it may be inserted into said mast and said second cylindrical portion having a diameter such that it may engage the base of said mast and rest thereon.

7. The apparatus of claim 5 wherein said first cylindrical portion includes spring clip means for removably securing said mounting means on the mast.

8. In a sailboard having a mast, a sail, a sheet for tensioning the sail, and a board, the board including a mast cup for removably attaching the mast thereto, a method for assembling the sailboard comprising the steps of:

(a) attaching the mast to the sail;

(b) passing the sheet through a first cleat attached to the base of the mast;

(c) providing a lever having a second cleat at one end and a grip at the other, the lever operating on a fulcrum between the ends;

(d) removably attaching the fulcrum and the lever to the base of the mast;

(e) passing the sheet through the second cleat;

(f) operating the lever in a ratcheting motion to apply tension to the sail;

(g) removing the sheet from the second cleat;

(h) removing the fulcrum and the lever from the base of the mast; and (i) inserting the mast into the mast cup to assemble the sail board.

* * * * *